US006375021B1

(12) United States Patent
Slenker

(10) Patent No.: US 6,375,021 B1
(45) Date of Patent: Apr. 23, 2002

(54) SELF CLOSING BOTTLE CAP FOR DISPENSING CHEMICALS WITH SWABS

(76) Inventor: Stephen Amram Slenker, 10 Crabapple La., Chelmsford, MA (US) 01824

( * ) Notice: Subject to any disclaimer, the term of this patent is extended or adjusted under 35 U.S.C. 154(b) by 0 days.

(21) Appl. No.: 09/624,588

(22) Filed: Jul. 24, 2000

(51) Int. Cl.[7] ..... B65D 43/18; G01N 35/00

(52) U.S. Cl. ..... 215/236; 215/303; 215/274; 220/820; 220/319; 436/180; 422/102; 401/132

(58) Field of Search ..... 215/236, 322, 215/274, 305, 303, 298; 220/820, 824, 823, 345.1, 319, 320; 222/557, 560; 401/132; 422/99, 101, 102; 436/180

(56) References Cited

U.S. PATENT DOCUMENTS

| | | | | |
|---|---|---|---|---|
| 1,090,883 | A | * | 3/1914 | Schott |
| 1,164,258 | A | * | 12/1915 | Conde |
| 1,494,745 | A | * | 5/1924 | Griffin et al. |
| 1,588,675 | A | * | 6/1926 | Gove |
| 2,030,380 | A | * | 2/1936 | Love |
| 2,237,162 | A | * | 4/1941 | Robinson |
| 2,552,397 | A | * | 5/1951 | Bretney |
| 2,749,727 | A | * | 6/1956 | Fabro |
| 4,124,150 | A | | 11/1978 | Moss |
| 4,389,004 | A | | 6/1983 | Bon |
| 4,519,530 | A | | 5/1985 | Schmidt |
| 4,541,550 | A | | 9/1985 | Del Bon |
| 4,739,906 | A | | 4/1988 | LoTurco |
| 5,014,880 | A | | 5/1991 | Loesel Jr. et al. |
| 5,199,597 | A | | 4/1993 | Gladish |
| 5,350,079 | A | | 9/1994 | Larson et al. |
| 5,529,224 | A | | 6/1996 | Chan |
| 5,865,352 | A | | 2/1999 | Leary |
| 5,996,845 | A | | 12/1999 | Chan |
| 6,265,225 | B1 | * | 7/2001 | Otto et al. |

FOREIGN PATENT DOCUMENTS

| | | | |
|---|---|---|---|
| EP | 909584 | * | 4/1999 |

* cited by examiner

*Primary Examiner*—Nathan J. Newhouse
(74) *Attorney, Agent, or Firm*—John V. Stewart

(57) ABSTRACT

A self-closing bottle cap having a cover plate (1) that is easily pushed aside with a light touch from a swab stick (17). The cover plate pivots aside and upward on a hinge (6) with an oblique pivot axis (10) that provides an ideal trajectory and gravity component for the cover plate motion. The cover plate is held aside with the swab stick while dipping the swab (18) into the bottle contents. When the swab is removed, the cover plate returns by gravity and closes the bottle. This allows an operator to easily open the bottle for each dipping of the swab, using only one hand with little distraction. The bottle remains closed at all times except briefly during each dip. This minimizes evaporation of chemicals into a working environment.

17 Claims, 2 Drawing Sheets

FIG 1
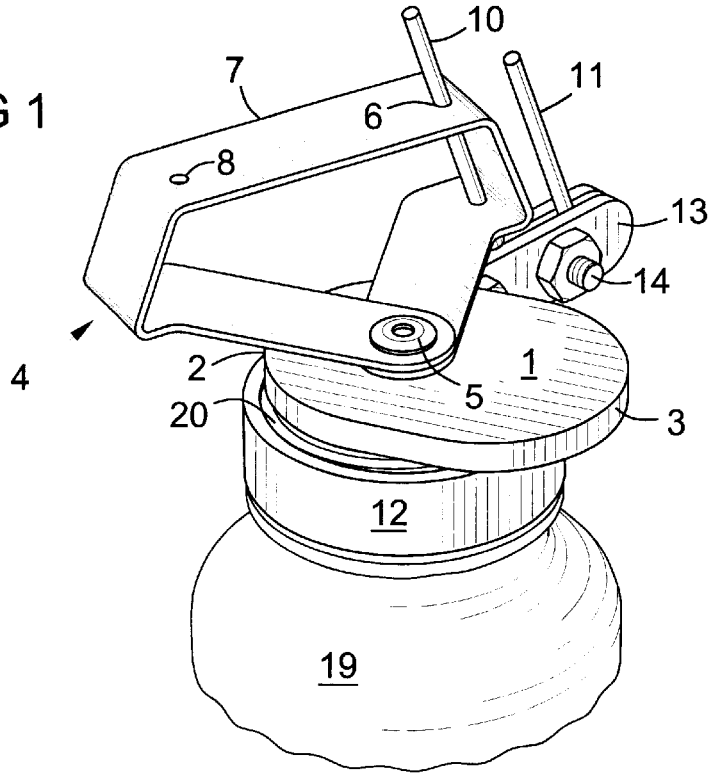
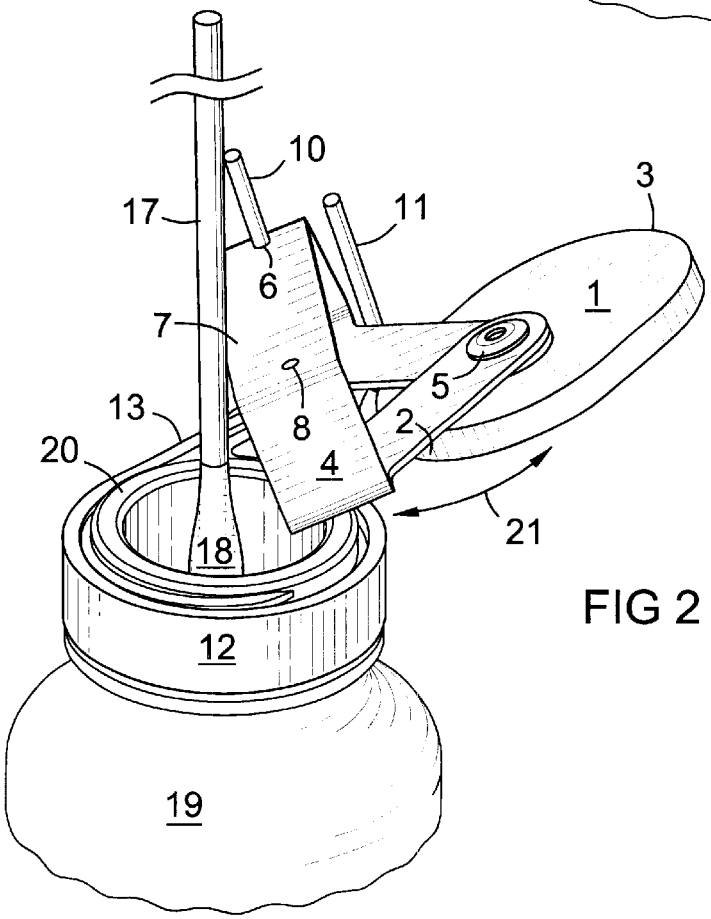
FIG 2

SELF CLOSING BOTTLE CAP FOR DISPENSING CHEMICALS WITH SWABS

BACKGROUND OF THE INVENTION

1. Field of the Invention

This invention relates to self-closing dispenser caps for brief access to a chemical in a bottle by dipping into the bottle through the cap with a swab.

2. Description of Prior Art

Industrial workstations often have small bottles of chemicals that are usually left uncapped during operations. These chemicals are typically used with long cotton swabs for cleaning, etching, cementing, and coating during assembly, fabrication, or repairs. Such chemicals have volatile ingredients that can vaporize and pollute the work environment. New environmental laws require even small containers to be capped. Substantial fines are imposed for a first offense, and daily for repeat offenses. However, the average operator does not keep replacing bottle caps, due to inconvenience and lost productivity, so the problem has been previously unsolvable.

Prior self-closing containers use a pivot axis parallel to the ground plane. This causes the cover to open by either going into the container or raising above the container. If the cover goes into the container, the container can only be partially filled, or the cover will be immersed in the contents of the container. If the cover is raised above the container, and returns by gravity, it must be latched open or awkwardly held by some other means during use. All prior devices known to the inventor have a pivot axis in a plane parallel to the opening surface. Examples of prior self-closing containers are found in U.S. Pat. Nos. 5,996,845, 5,529,224, 5,350,079, 5,199,597, 5,865,352, 5,014,880, 4,739,906, 4,541,550, 4,519,530, 4,389,004, and 4,124,150.

SUMMARY OF THE INVENTION

An objective of the present invention is provision of self-closing bottle cap that provides easy access to a chemical by an operator with a swab using only one hand and causing little distraction. Another objective is the described device requiring such a light touch that opening it with a swab does not move even an unrestrained small glass bottle. Another objective is quick automatic re-closure of the device to minimize evaporation of the contents into the environment. Another objective is an inexpensive mechanical design for the device using no electronics.

The invention is a self-closing bottle cap having a cover plate (1) that is easily pushed aside with a light touch from a swab stick (17). The cover plate pivots aside and upward on a hinge (6) with an oblique pivot axis (10) that provides an ideal trajectory and gravity component for the cover plate motion. The cover plate is held aside with the swab stick while dipping the swab (18) into the bottle contents. When the swab is removed, the cover plate returns by gravity and closes the bottle. This allows an operator to open the bottle easily for each dipping of the swab, using only one hand with little distraction. The bottle remains closed at all times except briefly during each dip. This minimizes evaporation of chemicals into a working environment.

BRIEF DESCRIPTION OF THE DRAWINGS

FIG. 1 is a perspective side view of the invention in its closed position.

FIG. 2 is the view of FIG. 1 in the open position.

REFERENCE NUMBERS

Figure 3:
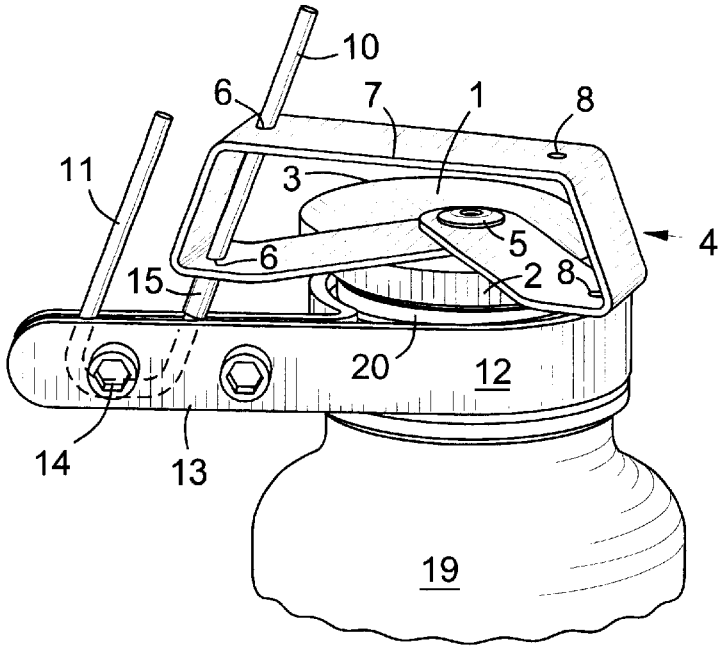
FIG. 3 is a perspective front view of the invention in its closed position.

1. Cover plate
2. Front or leading edge of cover plate as it swings downward by gravity
3. Back or trailing edge of cover plate as it swings downward by gravity
4. Pivoting frame
5. Connection of plate to frame
6. First pivot journal on frame
7. Push-bar or pressure surface on frame
8. Optional second pivot journal on frame for reverse mounting direction
10. Pivot rod
11. Pivot stop bar
12. Clamp band
13. Clamp extension arm
14. Bolt on clamp extension arms
15. Spacer sleeve
16. Vertical plane through pivot axis
17. Swab stick
18. Swab tip
19. Bottle
20. Bottle top
21. Trajectory of cover plate

TERMINOLOGY

Forward—The direction toward which the cover plate swings by gravity when closing.

Front—The edge of the cover plate toward which it swings by gravity when closing. The front side of the bottle opening is the side covered by the front edge of the cover plate.

DETAILED DESCRIPTION

Figure 4:
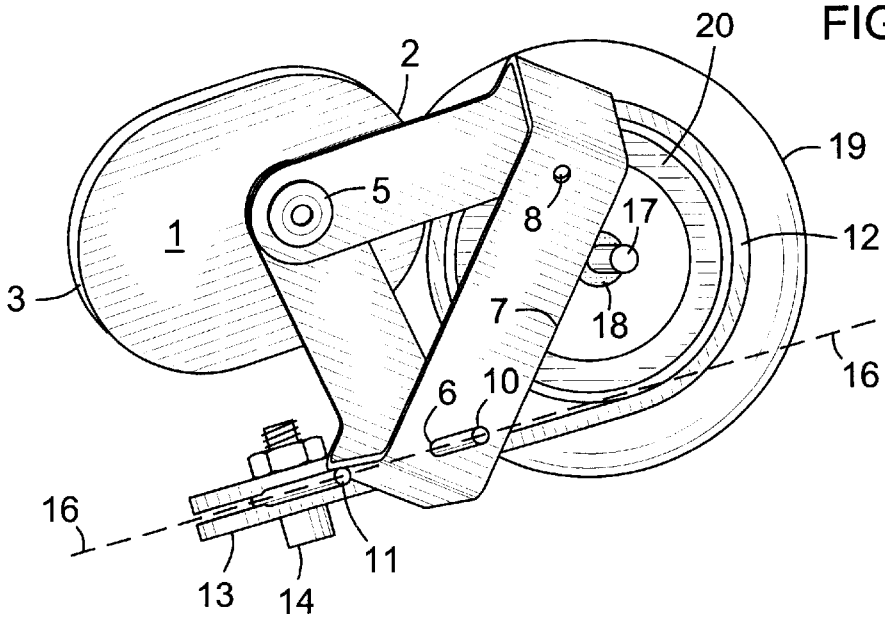
FIG. 4 is a top view of the invention in its open position.

As shown in FIGS. 1–4, a pivoting frame (4) is attached to an open bottle top (20) by means of a clamp band (12) tightened by bolts (14). The frame (4) holds a cover (1) on the bottle opening, and the frame pivot (6) allows the cover to be easily pushed aside. The pivot axis is defined by a pivot rod (10). The angle of the pivot axis causes the cover to return by gravity to seal the bottle opening.

The cover plate (1) is a pendulum that swings about the axis of the pivot rod (10) until it is stopped by contact with the bottle opening (20). The pivot rod is angled about 20 degrees from vertical, leaning approximately toward the front side of the bottle opening. The angle of the pivot rod determines the trajectory (21 in FIG. 2) of the cover plate. Each portion of the cover plate reaches its lowest point as it crosses the vertical plane (16 in FIG. 4) through the pivot axis, on the low side of the pivot rod. This plane (16) should pass outside or tangent to the bottle opening on the front side, so the cover plate is on its way down as it covers the opening. By setting the vertical position of the cover plate journal (6), the cover plate will "land" on the bottle opening. The vertical position of the journal is set by the length of a spacer sleeve (15) on the pivot bar (FIG. 3) and by the clamp band (12) attachment position. The type of landing of the cover plate is determined by the distance of the plane (16) from the edge of the opening (20). The closer the plane is to the edge of the bottle opening, the softer will be the landing, and the more the cover plate will slide across the opening after contact.

The absence of a closing spring allows the cover plate to be pushed aside very easily by a user. On the return fall, the cover plate can accelerate enough to slide into full contact with the bottle top, and seal the opening.

The cover plate is preferably slightly larger than the bottle opening to assure full coverage of the bottle opening without requiring a perfect alignment. The cover plate may be oval-shaped as shown, elongated in the direction of motion to providing a landing range. The cover plate should be made of a material that is inert to the chemicals being used. Some suggested materials are: inert plastic, silicone rubber backed with plastic, or stainless steel. A low-friction lower surface or coating on the cover is desirable so the cover can easily slide horizontally into and out of the closed position. The rivet (5) should be an inert material also, such as inert plastic or stainless steel.

A product designer may choose the material for the cover plate along with the trajectory of the landing to determine the ease of displacement of the plate. The goal is a cover plate so easily displaced that when installed on a small glass bottle it will not tip the bottle during opening, yet it seals the bottle to prevent ventilation. These goals have been fully achieved in prototypes made by the inventor.

A stop bar (11) is preferably provided to stop the pivoting frame (4) from overrotating past top dead center, which would cause the frame to fall backward rather than re-close the bottle. The pivot rod (10) and stop bar (11) are preferably formed from a single length of stiff wire bent into approximately an italic U-shape as shown by dashed lines in FIG. 3.

To assemble and install the invention on an open bottle, the clamp band (12) is placed around the bottle top, including the threads, if any. The pivot rod (10) and stop bar (11) are inserted and positioned between the halves of the clamp extension arm (13), and the bolts (14) are tightened partially. The spacer sleeve (15) is slid over the pivot rod, and the pivoting frame (4) is slid over the pivot rod. The cover plate (1) is positioned over the opening in the bottle top. The position of the pivot rod and clamp band are adjusted as needed for full contact of the cover plate over the bottle opening, then the bolts (14) are tightened.

To operate the invention, a user pushes against the front part (7) of the pivoting frame with a swab stick (17), displacing the cover plate (1) laterally and upward from the bottle opening (20). The user holds the cover aside with continued lateral pressure of the swab stick against the pivoting frame, while dipping the swab (18) into the contents of the bottle. The user then removes the swab from the bottle and away from the pivoting frame. The cover plate automatically swings back by gravity across the bottle opening, lands on it, and closes it.

Optionally, a second pivot journal (8) can be provided on the pivoting frame (4) to allow reversal of the pivot direction. To use the second pivot journal, the clamp bolts (14) are loosened, and the band is inverted on the bottle cap. The pivot rod (10) and stop (11) are inverted on the clamp extension arm (13), and the pivoting frame (4) is mounted on the pivot rod by the second pivot journal (8). The cover plate (1) is then rotated about its connection (5) to cover the bottle top. To make this possible, the cover plate should be frictionally rotatable about its attachment (5). This reversible feature gives a user the choice of clockwise or counterclockwise swing of the cover plate about the pivot rod.

This invention may be used in various applications, such as painting from a can. In this use, the cover prevents debris from falling into the paint, and prevents the paint from drying during breaks in paint application.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. A self-closing cap for a bottle top comprising:

a pivot rod;

means for attaching the pivot rod to a bottle top;

a cover plate;

a frame attached to the cover plate, the frame having a first journal;

a pivot axis defined by the pivot rod in the first journal;

the pivot axis oblique from vertical;

the pivot axis holding the cover plate in a first position covering a bottle top;

the pivot axis located in a vertical plane that does not pass inside the bottle top;

a push bar attached to the cover plate; and the cover plate displaced from the bottle top to a second position by force against the push bar;

whereby the cover plate returns by gravity to the first position.

2. The self-closing cap of claim 1 further comprising a second journal in the frame that provides an option for mounting the pivot rod in either the first or second journal for selecting the direction of rotation of the cover plate.

3. The self-closing cap of claim 1, wherein the cover plate has a trajectory with a top-dead-center about the pivot axis, and further comprising a stop to prevent the cover plate from reaching top-dead-center.

4. The self-closing cap of claim 3, wherein the means for attaching the pivot rod to a bottle top comprises a clamp with a band for encircling a bottle top, the band having two ends extending parallel to each other away from the bottle top, a bolt passing transversely through the two parallel ends, and the pivot rod and stop are formed from a single length of wire bent into approximately an italic U-shape, and held at a desired position compressed between the parallel ends of the clamp by the bolt.

5. The self-closing cap of claim 1 wherein the pivot axis is between 15 and 25 degrees from vertical.

6. The self-closing cap of claim 1 wherein the vertical plane through the pivot axis is tangent to the bottle top.

7. The self-closing bottle cap of claim 1, wherein the frame comprises a band of rigid material extending from a first point on the plate to a second point beside the leading edge of the plate to a third point above and ahead of the leading edge of the plate, the first point being connected to the plate, the second point having a pivot journal for receiving the pivot bar, and the third point providing the contact surface for pushing the plate aside.

8. A process of using the self-closing cap of claim 1 comprising the steps of:

providing a bottle with a top;

attaching the self-closing cap to the top of the bottle;

providing a fiber-tipped stick;

pushing against the push bar with the stick to move the plate aside;

dipping the fiber tip into the bottle while holding the plate aside with the stick against the push bar;

withdrawing the stick from the bottle.

9. A self-closing cap for a bottle top comprising:

a pivot rod;

a clamp for attaching the pivot rod to a bottle top;

a cover plate;

a frame attached to the cover plate, the frame having a first set of pivot holes;

a pivot axis defined by the pivot rod journalled through the first set of pivot holes;

the pivot axis oblique from vertical;

the pivot axis holding the cover plate in a first position covering a bottle top;

the pivot axis located in a vertical plane that does not pass inside the bottle top;

a push bar attached to the cover plate; and the cover plate displaced from the bottle top to a second position by force against the push bar;

whereby the cover plate returns by gravity to the first position.

10. The self-closing cap of claim 9 further comprising a second set of pivot holes in the frame, and wherein the clamp is reversible on a bottle top, providing an option for using either the first or second set of pivot holes for selecting clockwise or counterclockwise direction of rotation of the cover plate about the pivot axis.

11. The self-closing cap of claim 9, wherein the cover plate has a trajectory with a top-dead-center about the pivot axis, and further comprising a stop to prevent the cover plate from reaching top-dead-center.

12. The self-closing cap of claim 11, wherein the clamp comprises a band for encircling a bottle top, the band has two ends extending parallel to each other away from the bottle top, a bolt passing transversely through the two parallel ends, and the pivot rod and stop are formed from a single length of wire bent into approximately an italic U-shape, and held at a desired position compressed between the parallel ends of the clamp by the bolt.

13. The self-closing cap of claim 9 wherein the pivot axis is between 15 and 25 degrees from vertical.

14. The self-closing cap of claim 9 wherein the vertical plane through the pivot axis is tangent to the bottle top.

15. The self-closing bottle cap of claim 9, wherein the frame comprises a band of rigid material extending from a first point on the plate to a second point beside the leading edge of the plate to a third point above and ahead of the leading edge of the plate, the first point being connected to the plate, the second point having a pivot journal for receiving the pivot bar, and the third point providing the contact surface for pushing the plate aside.

16. A process of using the self-closing cap of claim 9 comprising the steps of:

providing a bottle with a top;

attaching the self-closing cap to the top of the bottle;

providing a fiber-tipped stick;

pushing against the push bar with the stick to move the plate aside;

dipping the fiber tip into the bottle while holding the plate aside with the stick against the push bar;

withdrawing the stick from the bottle.

17. A method for dispensing liquid from a bottle with a swab, comprising the steps of:

providing a bottle of liquid with an open top covered by a plate hinged to a pivot bar angled obliquely from vertical to pivot the plate aside and upward from the bottle top;

providing a pressure bar on the cover plate for pushing the plate about the pivot bar;

providing a fiber-tipped stick;

pushing against the pressure bar with the stick to move the plate aside;

dipping the fiber tip into liquid in the bottle while holding the plate aside with the stick against the pressure bar;

withdrawing the stick from the bottle;

whereby the liquid in the bottle is applied to the fibers using only one hand of a user and the bottle is only uncovered briefly for dipping the fibers in the liquid.

* * * * *